US008100488B2

(12) United States Patent
Eisele et al.

(10) Patent No.: US 8,100,488 B2
(45) Date of Patent: Jan. 24, 2012

(54) REFRIGERATING APPLIANCE WITH HEIGHT-ADJUSTABLE STORAGE DEVICE

(75) Inventors: Frank Eisele, Neu-Ulm (DE); Ralph Staud, München (DE); Thomas Tischer, Haar (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 633 days.

(21) Appl. No.: 12/225,453

(22) PCT Filed: Jan. 26, 2007

(86) PCT No.: PCT/EP2007/050796

§ 371 (c)(1),
(2), (4) Date: Sep. 18, 2008

(87) PCT Pub. No.: WO2007/110260

PCT Pub. Date: Oct. 4, 2007

(65) Prior Publication Data

US 2009/0121600 A1 May 14, 2009

(30) Foreign Application Priority Data

Mar. 27, 2006 (DE) ..... 10 2006 014 370

(51) Int. Cl.
*A47B 96/04* (2006.01)

(52) U.S. Cl. ..... 312/408; 312/325; 312/319.3; 108/106; 108/145

(58) Field of Classification Search ..... 312/408, 312/410, 325, 351, 319.3; 108/99, 106, 145, 108/147.11, 147.17, 138
See application file for complete search history.

(56) References Cited

U.S. PATENT DOCUMENTS

| | | | | | |
|---|---|---|---|---|---|
| 1,824,822 | A | * | 9/1931 | Kradolfer | 248/646 |
| 2,146,199 | A | | 2/1939 | Barnhardt | |
| 2,190,244 | A | * | 2/1940 | Row | 211/134 |
| 2,284,339 | A | | 5/1942 | Nauert | |
| 2,838,357 | A | | 6/1958 | Miller | |
| 2,852,329 | A | | 9/1958 | Smith | |
| 2,998,290 | A | * | 8/1961 | Sharpe | 312/303 |
| 3,288,090 | A | * | 11/1966 | King | 108/138 |
| 3,316,044 | A | * | 4/1967 | Carbary | 312/408 |

(Continued)

FOREIGN PATENT DOCUMENTS

DE 101 53 625 7/2002

OTHER PUBLICATIONS

International Search Report PCT/EP2007/050796.

*Primary Examiner* — Janet M Wilkens
*Assistant Examiner* — Daniel Rohrhoff
(74) *Attorney, Agent, or Firm* — James E. Howard; Andre Pallapies

(57) ABSTRACT

A refrigerating appliance including a housing defining an internal space and the refrigerating appliance including a storage element retained in a height-adjustable manner by a plurality of arms pivotable about parallel and spaced apart first axes fixed with respect to the housing and the plurality of arms pivotable about parallel and spaced apart second axes fixed with respect to the storage element, the refrigerating appliance including a coupling device connecting the plurality of arms wherein the first and second axes of the arms are maintained in the same plane, thereby inhibiting pivoting of the arms in opposite directions.

22 Claims, 5 Drawing Sheets

U.S. PATENT DOCUMENTS

| | | | | | |
|---|---|---|---|---|---|
| 3,352,431 | A | * | 11/1967 | Smith | 211/208 |
| 3,822,085 | A | * | 7/1974 | Clark | 312/351 |
| 3,982,801 | A | * | 9/1976 | Heidorn et al. | 312/306 |
| 4,021,088 | A | * | 5/1977 | Murray | 312/311 |
| 4,076,351 | A | * | 2/1978 | Wyant | 312/247 |
| 5,199,778 | A | * | 4/1993 | Aoki et al. | 312/408 |
| 5,462,347 | A | * | 10/1995 | Vogelgesang et al. | 312/247 |
| 5,626,323 | A | * | 5/1997 | Lechman et al. | 248/286.1 |
| 5,918,584 | A | * | 7/1999 | Kato | 123/681 |
| 6,065,821 | A | * | 5/2000 | Anderson et al. | 312/408 |
| 6,340,214 | B1 | * | 1/2002 | Adams | 312/246 |
| 6,691,626 | B2 | * | 2/2004 | Warner | 108/145 |
| 7,618,103 | B2 | * | 11/2009 | Kim | 312/408 |
| 2004/0195945 | A1 | * | 10/2004 | Farber et al. | 312/408 |
| 2005/0006995 | A1 | * | 1/2005 | Kim et al. | 312/325 |
| 2007/0176528 | A1 | * | 8/2007 | Lee et al. | 312/408 |
| 2009/0127993 | A1 | * | 5/2009 | Hrubesch | 312/408 |
| 2011/0031863 | A1 | * | 2/2011 | Benitsch et al. | 312/408 |

* cited by examiner

REFRIGERATING APPLIANCE WITH HEIGHT-ADJUSTABLE STORAGE DEVICE

BACKGROUND OF THE INVENTION

The present invention relates to a refrigerating appliance with a housing enclosing an internal space, and a storage element which is retained in the internal space in a height-adjustable manner by means of arms. Such a refrigerating appliance is known from DE 101 53 625 A1.

In this known refrigerating appliance, the storage element is a shelf which is supported on opposite sidewalls of the body with the aid of two arms per sidewall, the arms each being pivoted about parallel first axes fixed with respect to the housing and rotatably hinged to the shelf on second axes fixed with respect thereto. The shelf plate can assume two stable horizontal positions, the arms hanging down freely under the weight of the shelf in the lower of the two positions and the arms being pivoted upward in the higher position so that the second axes are higher than the first axes and closer than same to a back wall of the body. In this higher position the shelf plate is supported on the back wall of the body.

In addition to the two horizontal positions, the shelf plate of the known refrigerating appliance can also assume two inclined positions wherein in said positions one of two arms anchored in the same sidewall is hinged up and the other is hinged down in each case. Such an inclined position can be useful if, for example, refrigerated goods capable of rolling are to be stored on the shelf, the latter has a raised front edge which prevents the refrigerated goods from falling off in the inclined position, and it is to be ensured that the rollable refrigerated goods are accessible at all times on the front edge of the shelf. However, the ability of the known shelf to assume an inclined position results in the problem that when the height of the known shelf is to be adjusted in the loaded state, precise care must be taken to ensure that it does not tip, as otherwise there is a risk of refrigerated good falling down.

A solution already known from DE 101 53 625 A1 which prevents the attainment of a stable tipped position is to provide two pivoted arms on each side of the shelf. Although this can prevent a severely inclined position of the shelf, it cannot prevent shelf orientation instability if the first and second axes of all the arms are in the same plane.

BRIEF SUMMARY OF THE INVENTION

The object of the present invention is to specify a refrigerating appliance with a height-adjustable shelf of the type mentioned in the introduction, wherein tipping is eliminated throughout the high-adjusting movement of the refrigerated goods shelf.

This object is achieved in that the arms are linked by a coupling device which prevents the arms from pivoting in opposite directions in a position in which the first and second axes of the arms are in the same plane. This solution is based on the insight that the plate itself already constitutes a coupling device which only permits movement of the arms in the same direction, as long as the arms are not in the same plane. A supplementary coupling device therefore only needs to be operative in this critical position.

According to a first embodiment, the coupling device can be a system of rods hinged to third axes of the arms, the three axes of each arm defining the vertices of a triangle. Although such a system of rods would in itself allow rotation of the arms in opposite directions if the first and third axes are in the same plane, if this is the case the coupling by the storage element itself is operative, forcing the arms to rotate in the same direction.

According to alternative embodiments, the coupling device can also be a gear or belt drive mechanism. Such a mechanism is suitable for forcing a pivoting movement in the same direction in each orientation of the arms.

The shelf is preferably guided between two stable end positions of different heights via an unstable equilibrium position. In said unstable equilibrium position, the second axis of each arm lies vertically above its first axis in each case.

The freedom of the arms to pivot from the unstable equilibrium position is preferably less than 220° in each direction. This means that the end positions are stable without locking.

In order to make the height difference between the two end positions large, the freedom of the arms to pivot from the unstable equilibrium position in a first direction is preferably virtually zero and in the opposite direction about 220°. Advantageously, the freedom of the arms to pivot between the two end position is altogether 220°.

For safety, locking of the storage element can be provided at least in the higher of the two end positions.

The coupling device is preferably accommodated in a recess of an inner wall of the appliance. The arms can also be accommodated in the recess so that an essentially flat, easy-to-clean inner wall of the appliance is obtained.

For the same purpose it is also advantageous if the arms are implemented as circular disks concentric with the first axes.

The storage element can be a shelf plate suspended from the body of the housing, but can also be a door storage element suspended from the door of the refrigerating appliance.

In the latter case, the door preferably has vertical members projecting into the internal space and the arms are attached to mutually parallel sides of the vertical members.

Whereas, in the case of a shelf plate suspended from the body, two arms attached to the same sidewall of the body will generally be spaced apart in the depth direction, in the case of a door storage element two arms disposed in the same side are preferably spaced apart vertically.

BRIEF DESCRIPTION OF THE DRAWINGS

Further features and advantages of the invention will emerge from the following description of exemplary embodiments and with reference to the accompanying drawings in which.

DETAILED DESCRIPTION OF THE PRESENT INVENTION

Figure 1:
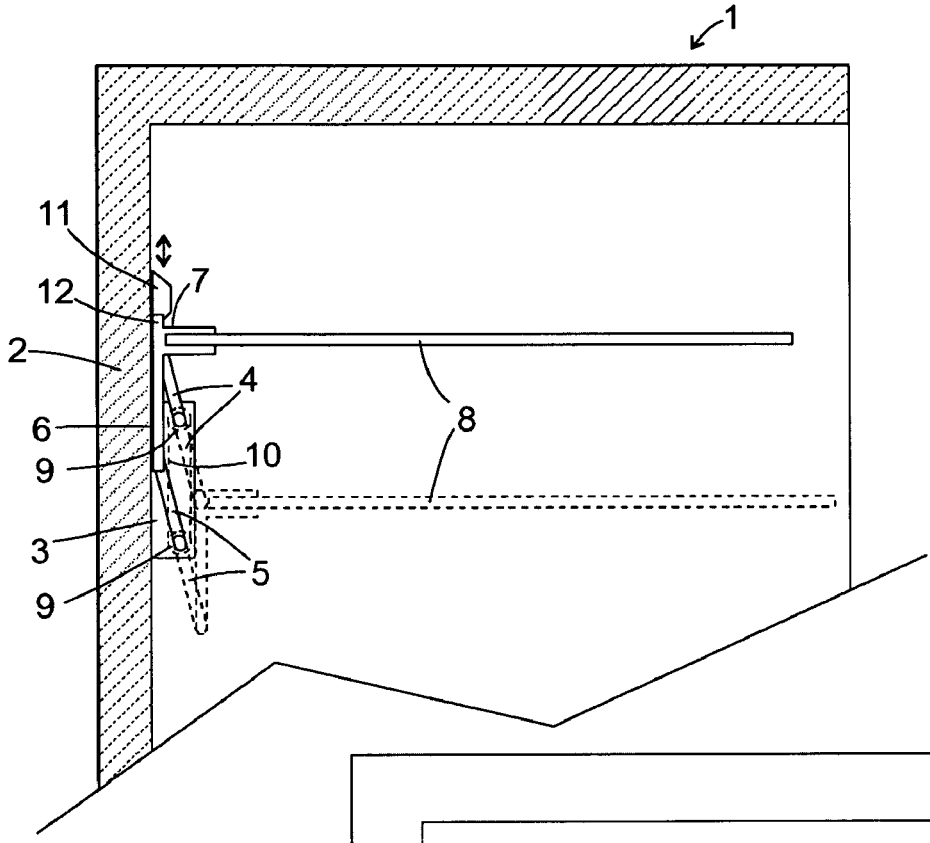
FIG. 1 shows a schematic cross-section through the body of a refrigerating appliance according to a first embodiment of the invention.

FIG. 1 shows a schematic partial cross-section through the body of a refrigerating appliance according to a first embodiment of the invention. Fixed to a back wall 2 of the body 1 is a flat cuboidal support block 3. As can be seen particularly from FIG. 2, first ends of upper and lower arms 4, 5 are hinged to sidewalls of the support block 3 in each case. Second ends of the arms 4, 5 are hinged to vertical bars 6 on either side of the support block. The bars 6 are fixedly connected to a clamping holder 7 in which a shelf 8 in the form of a plate of safety glass is held clamped.

The arms 4, 5 can pivot through 220° between a raised position represented by solid lines in the figure and a lowered position represented by dashed lines. In the raised position, the bar 6 and the clamping holder 7 directly abut the back wall 2 of the body and are held in this position by the own weight of the shelf 8 and possibly the weight of refrigerated goods stored thereon. In the lowered position, the clamping holder 7 is supported on the front of the support block 3.

Accommodated inside the support block 3 are two toothed wheels 9 which are non-torsionally connected to the ends of the arms 4, 5 and are wrapped around by a toothed belt 10.

In order to lower the shelf to a position represented by dashed lines, it is sufficient to manually pull it by its front edge and then slowly lower it until the back of the clamping holder 7 comes up against the front of the support block 3.

In order to prevent the clamping holder 7 from striking the support block 3 hard due to careless lowering, causing refrigerated goods to fall over on the shelf 8, damping means can additionally be provided, such as a friction brake acting on a shaft connecting the toothed wheels 9 to the arms 4, 5.

According to a first variant, to secure the shelf 8 in its raised position on the back wall 2, a latch 11 guided in a vertically displaceable manner can be provided which in its position shown in FIG. 1 encloses a projection 12 of the clamping holder 7 so that the shelf 8 cannot be pulled out and lowered unless the latch 11 is first lifted. The latch 11 has on its front side a beveled shoulder which is pushed up by the projection 12 when the shelf is moved to the raised position so that the shelf is automatically locked in this position.

Figure 2:
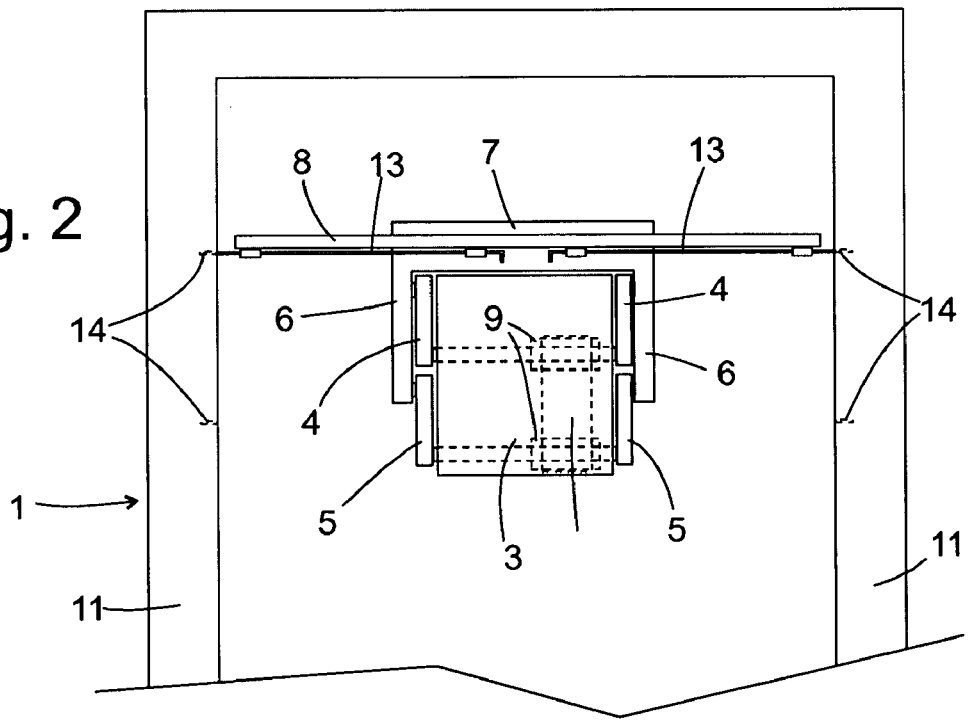
FIG. 2 shows a front view of the refrigerating appliance from FIG. 1.

According to a second variant, instead of the latch 11, there are provided on the front edge of the shelf 8, as shown in FIG. 2, two elongated latches 13 which, forced apart by a spring, engage in recesses 14 in sidewalls 11 of the body 1 in the raised and lowered position of the shelf 8, thereby securing and supporting the shelf 8 in its position.

Figure 3:
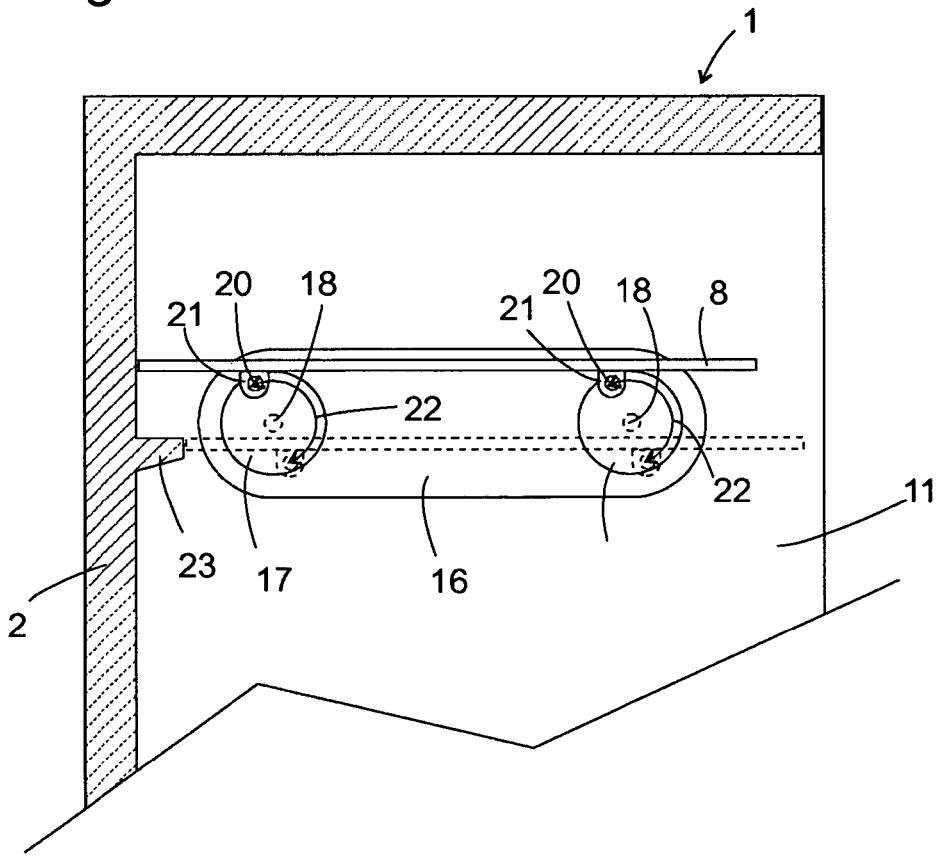
FIG. 3 shows a cross-section analogous to FIG. 1 according to a second embodiment of the invention.

FIG. 3 shows a cross-section through the body 1 of an inventive refrigerating appliance according to a second embodiment of the invention. In a sidewall 11 of the body 1 there is formed a depression which is concealed by a cover 16 having two circular openings. In the openings of the cover 16, two circular disks 17 are exposed which are pivoted in the wall 11 about a spindle 18 concentric with the circular disks 17 and concealed by same and therefore represented by dashed lines.

Figure 4:
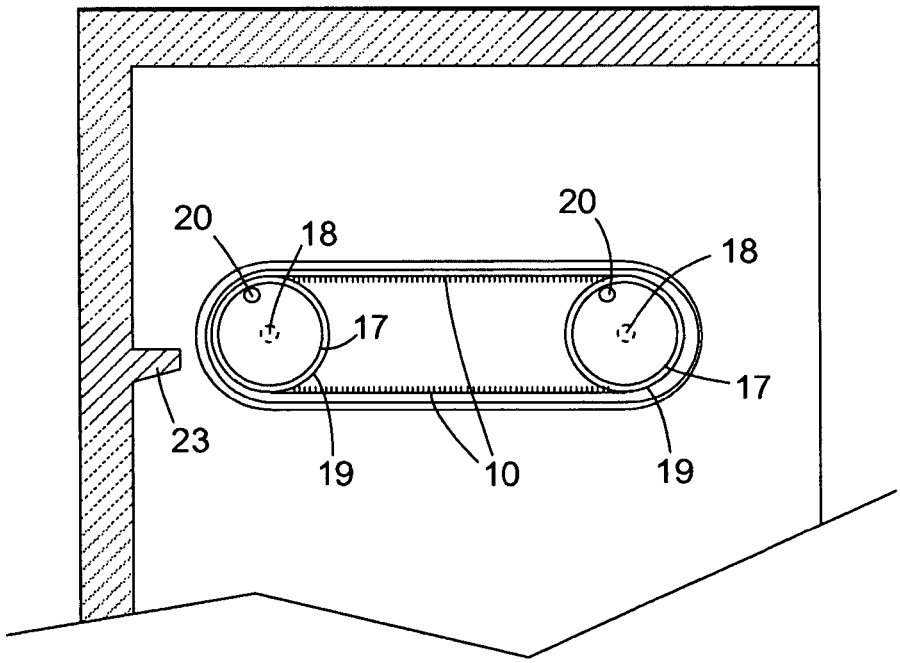
FIG. 4 is a view analogous to FIG. 3 showing the coupling device between the arms supporting the shelf.
Figure 11:
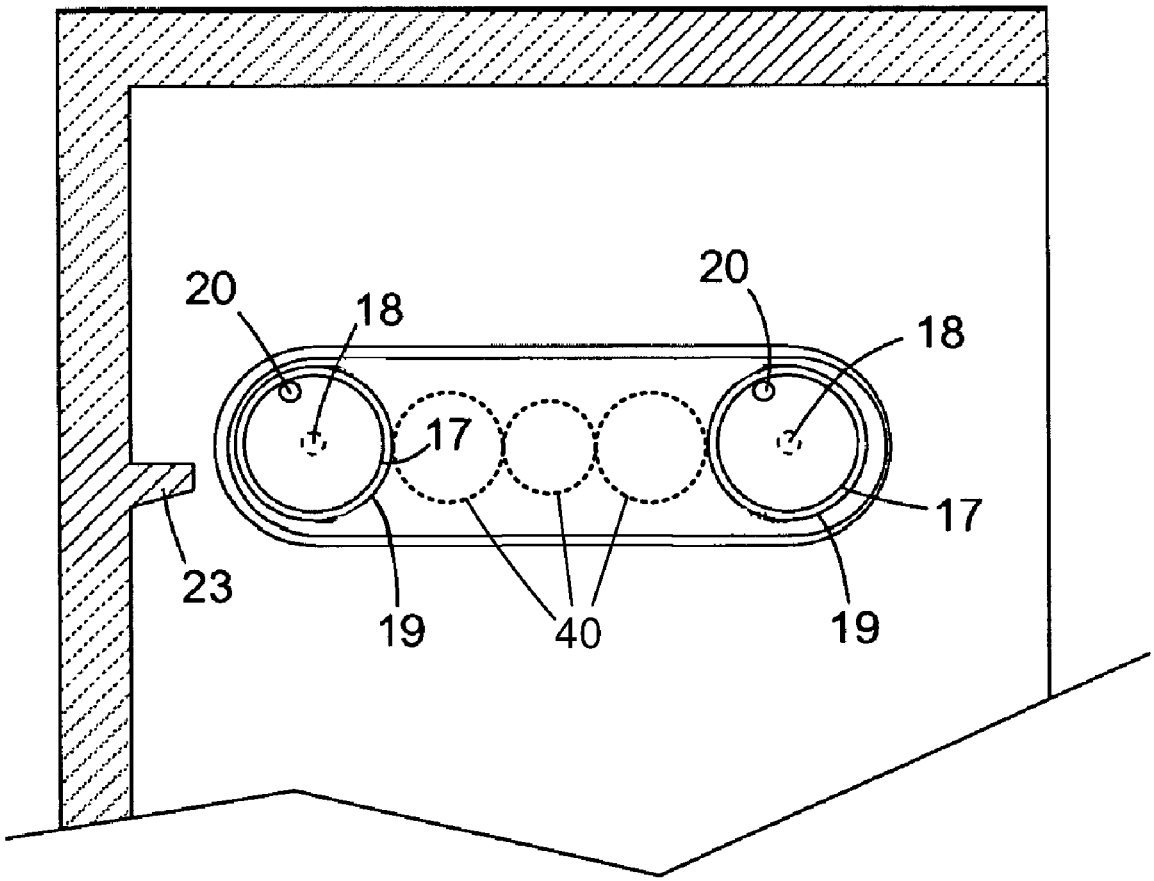
FIG. 11 shows a cross-section analogous to FIG. 4 according to an alternate embodiment of the coupling device.

As can be seen in FIG. 4 which shows a view of the sidewall 11 without the cover 16, the circular disks 17 are non-torsionally connected to toothed wheels 19 which are linked to one another by a toothed belt 10 passing around them. The toothed belt 10 could here, as also in the case of the embodiment in FIGS. 1 and 2, be replaced by a gear mechanism which ensures same-direction, equally fast rotation of the circular disks 17 or more specifically of the arms 4, 5. FIG. 11 shows an example of a gear mechanism that connects toothed wheels 19 to each other with a plurality of gears 40 instead of belt 10. Although three gears 40 are shown in FIG. 11, any number and configuration of gears can be used as long as the two toothed wheels 19 rotate in the same direction. Gears 40 are shown in dotted lines so as to not represent any specific configuration of gears. Gears 40 are supported by a support mechanism, such as, for example, shafts, which are not shown.

The circular disks 17 each carry an eccentric spindle 20 which engages in a bearing 21 on the underside of the shelf 8. Rotation of the circular disks 17 enables the shelf 8 to be moved between two stable positions at different heights, the upper of which is represented by solid lines in FIG. 3, the lower by dashed lines. The rotation of the circular disks 17 between the two positions, represented by arrows 22 in FIG. 3, is 180°. In the upper position, the freedom of rotation of the circular disks 17 is limited by direct contact of the shelf 8 with the back wall 2 of the body 1; in the lower position by contact with a ledge 23 projecting from the back wall 2 into the internal space.

Figure 5:
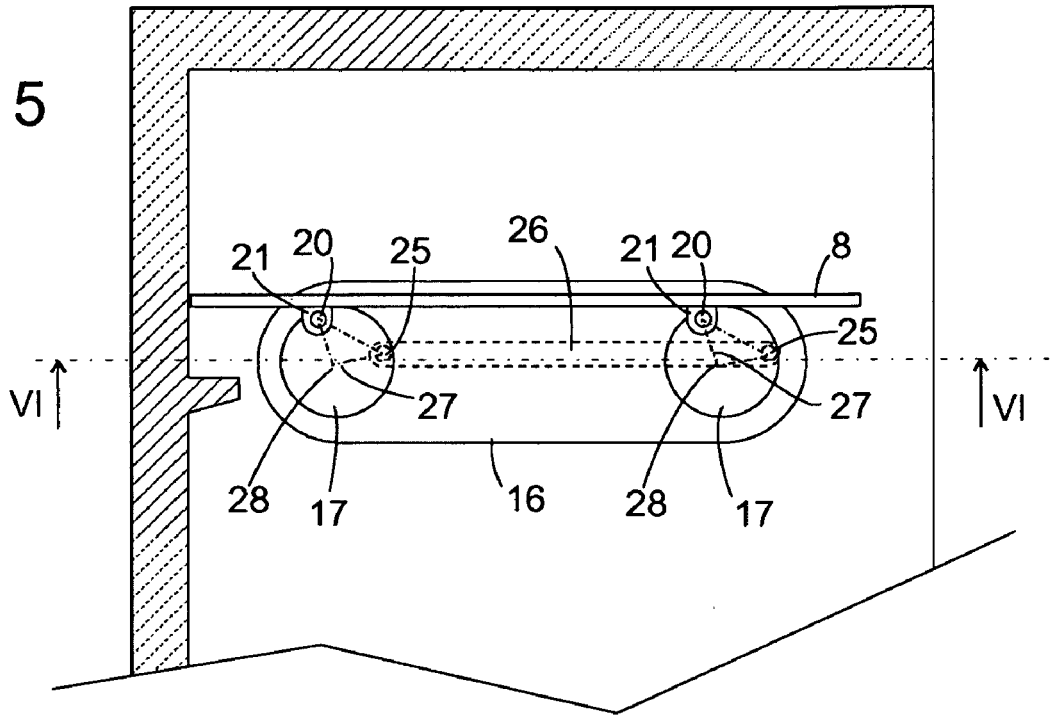
FIG. 5 is a view analogous to FIG. 3 showing a second embodiment of the coupling device.
Figure 6:
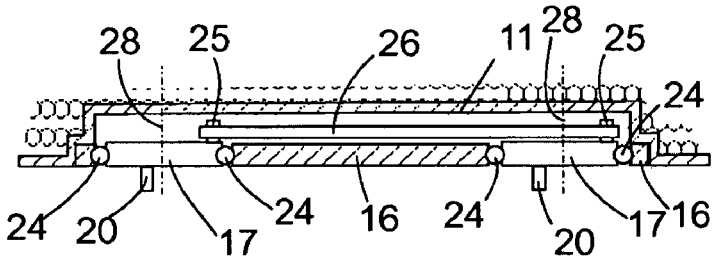
FIG. 6 shows a cross-section through the coupling device of FIG. 5.

FIG. 5 shows a similar view to FIG. 3 according to a third embodiment of the invention. Once again, two circular disks 17 are pivotally mounted in a sidewall 11 in a recess concealed by a cover 16, said disks carrying eccentrically protruding spindles 20 accommodated in bearings 21 of a shelf 8. As can be seen in FIG. 6, which shows a section along a line VI-VI in FIG. 5, the circular disks 17 are held in a easily pivotable manner with the aid of rolling-element bearings 24 in the cover 16. On one side of the circular disks 17 facing the sidewall 11 there projects in each case a spindle 25. The spindles 25 are rotationally accommodated in drilled holes at the ends of a rod 26 concealed behind the cover 16. The rolling-element bearings 24 and the spindles 20, 25 define on each circular disk 17 three axes which, as shown in FIG. 5, describe a triangle 27, the vertex of the triangle defined by the axis of rotation 28 of the rolling-element bearings 24 being approximately a right angle.

As may easily be imagined, without coupling by the rod 26 it would be possible to rotate the circular disks 17 in opposite directions, thus causing an inclined position of the shelf 8 if the axes 28 and the spindles 20 are in the same plane. If this is the case, however, the spindles 25 lie outside this plane, and their coupling via the rod 26 forces rotation in the same direction even in this position, thereby eliminating an inclination of the shelf 8.

The invention hitherto described with reference to a shelf as an example of a height-adjustable storage element is also applicable to door storage elements as will be explained below with reference to FIGS. 7 to 10.

Figure 7:
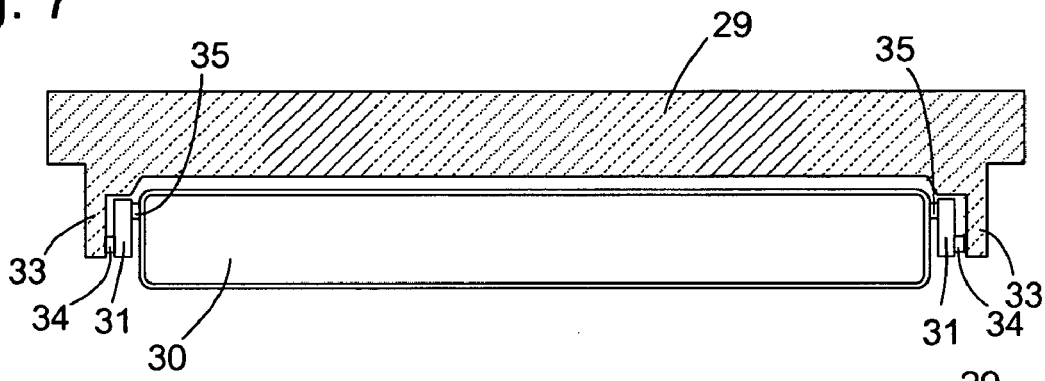
FIG. 7 shows a horizontal section through a door with a door storage element according to the invention suspended therefrom.
Figure 8:
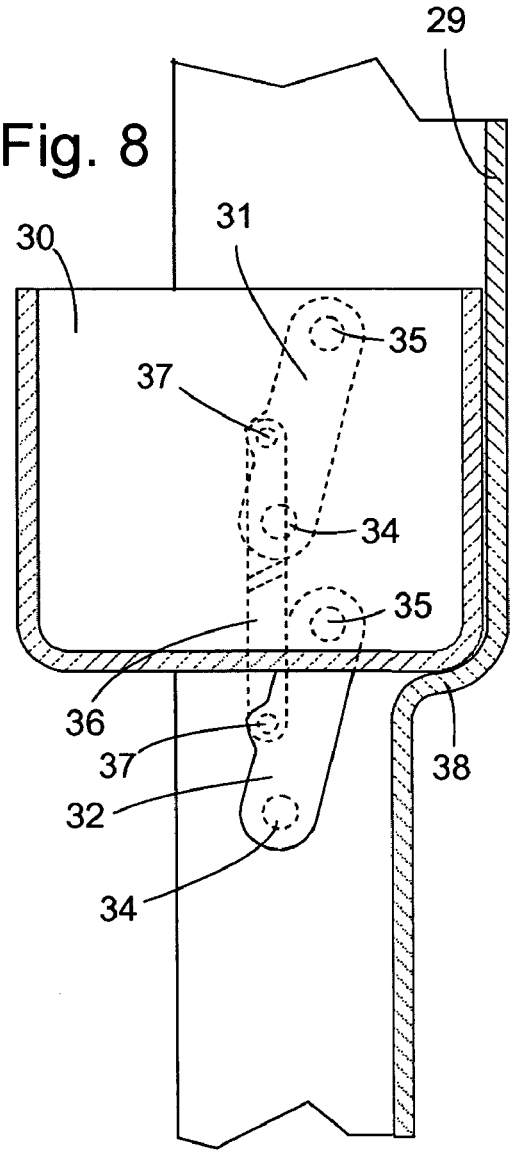
FIG. 8 shows a partial vertical section through the door and the door storage element in the raised position.
Figure 9:
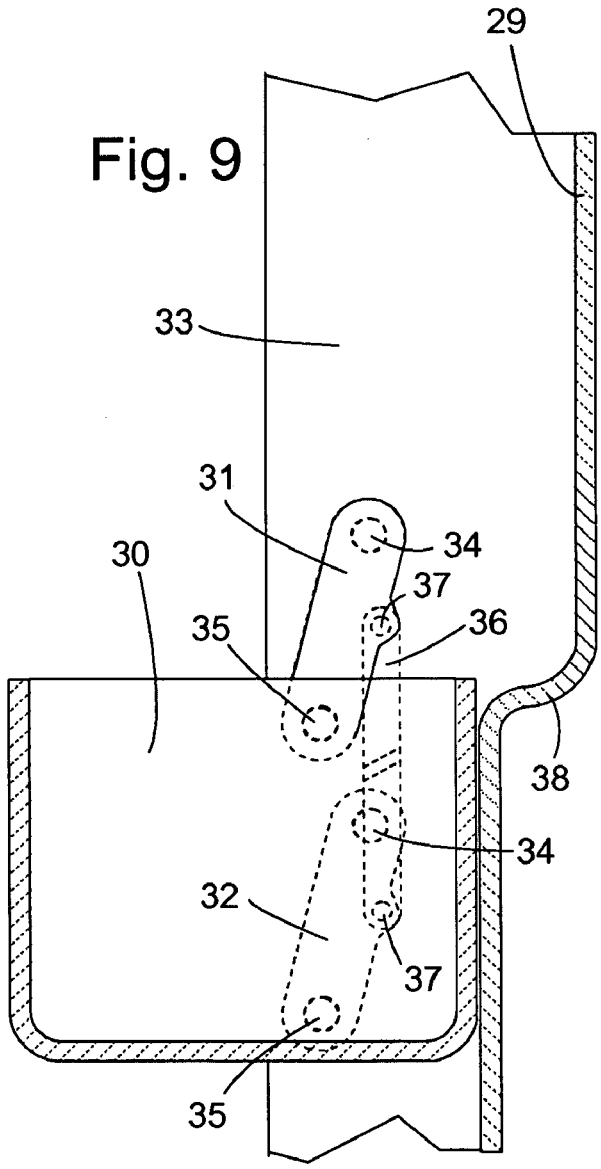
FIG. 9 shows a cross-section analogous to FIG. 8 with the door storage element in the lowered position.

FIG. 7 shows a horizontal section through a refrigerating appliance door 29 in which a door storage element 30 can be seen in plan view. The door storage element 30 is suspended via pivoted arms 31, 32 on vertical members 33 projecting from the door 29 into the interior of a refrigerating appliance. As shown in FIGS. 8 and 9, two arms 31, 32 are disposed one above the other between each vertical member 33 and the door storage element 30. The arms 31, 32 each carry a pin 34 engaging in a pivoted manner in a recess of the vertical member 33 and a pin 35 correspondingly engaging in a recess of the door storage element 30, each defining a fixed axis of rotation with respect to the door 29 or more specifically to the door storage element 30. The two arms 31, 32 are interconnected by a rod 36 in each case via pins 37 defining a third axis. Once again the three axes describe a triangle.

Figure 10:
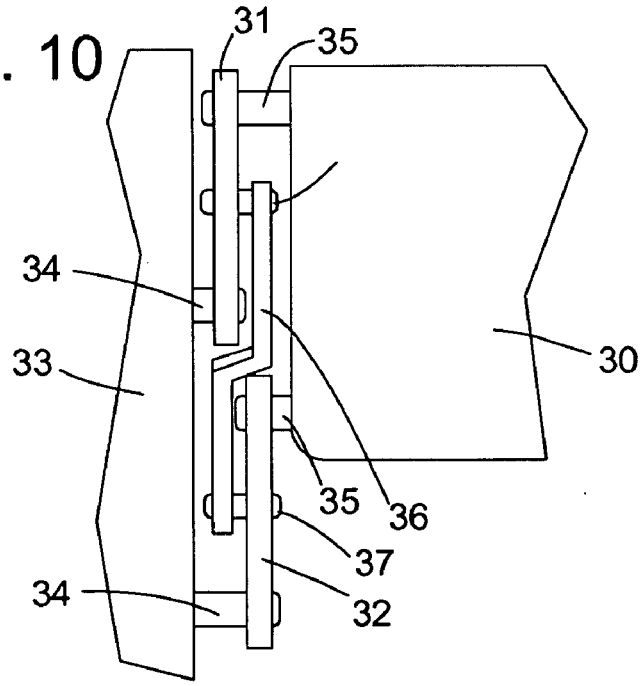
FIG. 10 shows a front view of a detail of the suspension of the door storage element.

As can be seen in FIG. 10, the rod 36 has an offset and extends on the one hand between the upper arm 31 and a sidewall of the door storage element 30 and, one the other, between the lower arm 32 and the adjacent upright 33. The offset prevents the rod 36 from striking one of the pins 34, 35 during positional adjustment of the door storage element 30 and thus impeding this adjustment.

On the inside of the door 29, a step 38 is placed such that, in the raised position, the door storage element 30 touches the inside of the door above the step 38 and, in the lowered position, below said step. Thus, in both positions the inside of the door forms a stop which delimits the freedom of movement of the door storage element 30. In both positions the door storage element 30 is pressed by its own weight and that of its contents against the inside of the door so that its position is stable.

The invention claimed is:

1. A refrigerating appliance comprising:

a housing defining an internal space;

a support member attached to the housing;

a storage element retained in a height-adjustable manner by a plurality of arms pivotable about parallel and spaced apart first axes fixed with respect to the housing, the plurality of arms being pivotable about parallel and spaced apart second axes fixed with respect to the storage element, and a coupling device connecting the plurality of arms such that the first axes are maintained in a first plane and the second axes are maintained in a second plane, and the first plane is maintained parallel to the second plane thereby inhibiting pivoting of the arms in opposite directions, wherein the storage element is movable between a first position at a first positional limit of the pivoting of the arms and a second position at a second positional limit of the pivoting of the arms, the second positional limit being opposite the first positional limit, and the storage element is configured to rest against the housing or the support member in both the first position and the second position under only the force of gravity.

2. The refrigerating appliance according to claim 1 wherein a third axis offset parallel to the first and second axis is formed on each of the plurality of arms and wherein the coupling device includes a plurality of rods hinged to the third axes.

3. The refrigerating appliance according to claim 2 wherein the three axes define the vertices of a triangle.

4. The refrigerating appliance according to claim 1 wherein the coupling device is formed as a gear mechanism.

5. The refrigerating appliance according to claim 1 wherein the storage element is configured for guidance between two stable end positions of different heights.

6. The refrigerating appliance according to claim 5 wherein the plurality of arms are configured in a manner wherein the freedom to pivot of the arms from an unstable equilibrium position is less than 180° in each direction.

7. The refrigerating appliance according to claim 5 wherein the plurality of arms are configured in a manner wherein the freedom to pivot of the arms between the two end positions is 180°.

8. The refrigerating appliance according to claim 1 and further comprising means for locking the storage element in at least one end position.

9. The refrigerating appliance according to claim 1 and further comprising a recess defined in an inner wall of the housing for operationally receiving the coupling device.

10. The refrigerating appliance according to claim 9 wherein the recess is configured for operationally receiving the plurality of arms.

11. The refrigerating appliance according to claim 10 wherein the arms are formed as circular disks concentric with the first axes.

12. The refrigerating appliance according to claim 1 wherein the storage element is formed as a shelf plate suspended on the body of the housing.

13. The refrigerating appliance according to claim 1 wherein the storage element is a door storage element suspended on a door of the body.

14. The refrigerating appliance according to claim 13 and further comprising vertical members formed on the door and projecting into the internal space wherein the arms are attached to mutually parallel sides of the vertical members.

15. The refrigerating device according to claim 1 wherein the coupling device is a belt and gear drive mechanism.

16. A refrigerating appliance comprising:

a housing defining an internal space;

a storage element retained in a height-adjustable manner by a plurality of arms pivotable about parallel and spaced apart first axes fixed with respect to the housing, the plurality of arms being pivotable about parallel and spaced apart second axes fixed with respect to the storage element; and a coupling device connecting the plurality of arms such that the first axes are maintained in a first plane and the second axes are maintained in a second plane, and the first plane is maintained parallel to the second plane thereby inhibiting pivoting of the arms in opposite directions, wherein the coupling device is a belt and gear drive mechanism.

17. A refrigerating appliance comprising:

a housing defining an internal space;

a support member attached to the housing;

a storage element retained in a height-adjustable manner by a plurality of arms pivotable about parallel and spaced apart first axes fixed with respect to the housing, the plurality of arms being pivotable about parallel and spaced apart second axes fixed with respect to the storage element, and a coupling device connecting the plurality of arms such that the first axes are maintained in a first plane and the second axes are maintained in a second plane, and the first plane is maintained parallel to the second plane thereby inhibiting pivoting of the arms in opposite directions, wherein the coupling device includes a first wheel fixed to one of the arms, a second wheel fixed to another of the arms, and a rotation joining mechanism that synchronizes the rotation of the first wheel and the rotation of the second wheel, and the storage element is configured to rest against the housing or the support member in both the first position and the second position under only the force of gravity.

18. The refrigerating appliance according to claim 17 wherein the rotation joining mechanism is at least one gear.

19. The refrigerating appliance according to claim 17 wherein the rotation-joining mechanism is a rod.

20. The refrigerating appliance according to claim 17 wherein the arms are integral with the first and second wheels.

21. The refrigerating appliance according to claim 17 wherein the first and second wheels and the rotation joining mechanism are recessed into a wall of the housing.

22. A refrigerating appliance comprising: a housing defining an internal space; a support member attached to the housing; a storage element retained in a height-adjustable manner by a plurality of arms pivotable about parallel and spaced apart first axes fixed with respect to the housing, the plurality of arms being pivotable about parallel and spaced apart second axes fixed with respect to the storage element, and a coupling device connecting the plurality of arms such that the first axes are maintained in a first plane and the second axes are maintained in a second plane, and the first plane is maintained parallel to the second plane thereby inhibiting pivoting of the arms in opposite directions, wherein the coupling device includes a first wheel fixed to one of the arms, a second wheel fixed to another of the arms, and a rotation-joining mechanism that synchronizes the rotation of the first wheel and the rotation of the second wheel, and wherein the rotation-joining mechanism is a belt.

* * * * *